US010900650B2

(12) United States Patent
Wang

(10) Patent No.: US 10,900,650 B2
(45) Date of Patent: Jan. 26, 2021

(54) FIXING FRAME, LIGHT-EMITTING DECORATIVE ASSEMBLY, AND DECORATIVE LIGHT

(71) Applicant: Quanzhou Viition Gifts Co., Ltd., Fujian (CN)

(72) Inventor: Peijun Wang, Fujian (CN)

( * ) Notice: Subject to any disclaimer, the term of this patent is extended or adjusted under 35 U.S.C. 154(b) by 0 days.

(21) Appl. No.: 16/420,178

(22) Filed: May 23, 2019

(65) Prior Publication Data

US 2019/0360672 A1 Nov. 28, 2019

(30) Foreign Application Priority Data

May 25, 2018 (CN) ..... 2018 1 0518745

(51) Int. Cl.

| | |
|---|---|
| ***F21V 23/00*** | (2015.01) |
| ***F21L 4/08*** | (2006.01) |
| ***F21V 21/108*** | (2006.01) |
| ***F21V 21/116*** | (2006.01) |
| ***F21W 121/00*** | (2006.01) |

(52) U.S. Cl.

CPC ..... *F21V 23/001* (2013.01); *F21L 4/08* (2013.01); *F21V 21/108* (2013.01); *F21V 21/116* (2013.01); *F21W 2121/00* (2013.01)

(58) Field of Classification Search

CPC ..... F21W 2121/00; F21S 4/10

See application file for complete search history.

(56) References Cited

U.S. PATENT DOCUMENTS

| | | | | |
|---|---|---|---|---|
| 7,152,998 | B2 * | 12/2006 | Rahman | A47G 33/06 362/249.19 |
| 9,060,575 | B2 * | 6/2015 | Chien | F21V 23/06 |
| 9,541,231 | B1 * | 1/2017 | Owens | F21V 19/0015 |
| 10,184,654 | B1 * | 1/2019 | Chen | F21S 4/10 |
| 10,288,236 | B1 * | 5/2019 | Chen | A47G 33/06 |
| 2005/0136197 | A1 * | 6/2005 | Liu | A41G 1/005 428/13 |
| 2005/0157485 | A1 * | 7/2005 | Shieh | F21V 21/0824 362/96 |
| 2006/0152946 | A1 * | 7/2006 | Chien | H01R 33/09 362/641 |
| 2007/0048464 | A1 * | 3/2007 | Haupt | A41G 1/00 428/17 |

(Continued)

*Primary Examiner* — Britt D Hanley

(74) *Attorney, Agent, or Firm* — Prakash Nama; Global IP Services, PLLC

(57) ABSTRACT

A fixing frame, a light-emitting decorative assembly, and a decorative light is disclosed, wherein a fixing frame contains a mounting portion and a support portion disposed on the mounting portion; one or both of the mounting portion and the support portion is/are arranged with a wire having light-emitting components; the light-emitting decorative assembly has a decorative piece and a fixing frame, and the decorative piece is removably mounted on the fixing frame; the decorative light has a support and a plurality of light-emitting decorative assemblies fixed on the support; fixing frames are fixed on the supporting frame. The fixing frame is used to mount the decorative piece, while the wire is arranged on the fixing frame, yet the wire and the decorative piece has no direct contact that results in tangling. As such, the decorative piece can be easily mount and dismount, and can be easily replaced.

8 Claims, 6 Drawing Sheets

(56) References Cited

U.S. PATENT DOCUMENTS

| | | | | |
|---|---|---|---|---|
| 2008/0123353 | A1* | 5/2008 | Liu | F21V 33/0052<br>362/375 |
| 2010/0117542 | A1* | 5/2010 | Van Dyn Hoven | F21V 3/00<br>315/149 |
| 2010/0254160 | A1* | 10/2010 | Chan | A47G 33/06<br>362/653 |
| 2012/0044683 | A1* | 2/2012 | Tong | F21S 4/15<br>362/249.01 |
| 2014/0185295 | A1* | 7/2014 | Presswood, Jr. | F21S 2/005<br>362/249.08 |
| 2017/0057696 | A1* | 3/2017 | Ansaldo-Swain | A01G 31/00 |

* cited by examiner

FIXING FRAME, LIGHT-EMITTING DECORATIVE ASSEMBLY, AND DECORATIVE LIGHT

BACKGROUND OF THE INVENTION

The present invention relates to the technical field of lighting, and more specifically relates to a fixing frame, a light-emitting decorative assembly, and a decorative light.

Nowadays, a decorative light is a lighting product to add a mood to an internal environment. Decorative lights now available in the market have various different designs.

A decorative light according to the prior art usually wind the wires directly onto the decorative pieces, but this affects the visual appearance of the decorative pieces, and makes the decorative pieces difficult to install and uninstall. For example, when it is required to uninstall the decorative pieces, the wires have to be removed first before the decorative pieces can be uninstalled. Further, in many decorative lights according to the prior art, there is a problem of tangling wires, thereby lowering the efficiency of wire arrangement and also affecting the outer appearance of the decorative light or obstructing the use of the decorative light. Moreover, a degree of illuminance may also be different on different parts of the decorative light due to uneven distribution of wires.

BRIEF SUMMARY OF THE INVENTION

In view of the aforesaid disadvantages now present in the prior art, the present invention provides a decorative light that is structurally simple and easy to install and uninstall, light-emitting decorative assemblies used with the decorative light which allow respective decorative pieces thereon to be conveniently uninstall, and a fixing frame specified to be used with each light-emitting decorative assembly.

To fulfill the above objects, the present invention provides the following technical solutions:

1. A fixing frame, comprising a mounting portion and a support portion disposed on the mounting portion; one or both of the mounting portion and the support portion is arranged with a wire having light-emitting components.

2. The fixing frame is provided with wire slots that allow the wire to pass through.

3. The support portion extends radially and outwardly from the mounting portion.

4. Clamping arms defining the support portion extend radially and outwardly from the mounting portion; a free end of each clamping arm is bended as a bended portion.

5. A plurality of guiding plates are connected with the mounting portion; the guiding plates are each being arranged between two adjacent clamping arms; each wire slot is defined between a corresponding guiding plate and a corresponding clamping arm.

6. A light-emitting decorative assembly, comprising a decorative piece and a fixing frame, and also comprising a wire; the decorative piece is removably mounted on the fixing frame; the wire is disposed on the fixing frame; the wire is disposed with light-emitting components that emit lights passing through the decorative piece.

7. The fixing frame is provided with wire slots; the wire is arranged on the fixing frame via the wire slots.

8. The decorative piece is a decorative sheet having a flower shape; the decorative sheet comprises a plurality of petals; a recessed portion cooperative with the fixing frame is provided between every two adjacent petals.

9. The decorative sheet is transparent.

10. The decorative sheet is made by transparent material, or the decorative sheet is provided with hollowed portions to achieve light permeation.

11. A decorative light, comprising a support and a plurality of light-emitting decorative assemblies fixed on the support; each light-emitting decorative assembly comprises a decorative piece, a fixing frame, and a wire; the fixing frame of each light-emitting decorative assembly is fixed on the support; the wire and the decorative piece are independently disposed on a corresponding fixing frame; the decorative piece is removably mounted on the corresponding fixing frame; the wire is disposed with light-emitting components that emit lights passing through each decorative piece.

12. The fixing frame is provided with wire slots; the wire is fixed on each fixing frame via wire slots of different positions in each fixing frame.

13. The fixing frame has three clamping arms or four clamping arms; the light-emitting components of the wire are disposed correspondingly to the decorative pieces respectively.

14. Each light-emitting component is mounted between a corresponding fixing frame and a corresponding decorative piece, or mounted at a corresponding fixing frame at a position corresponding to an installation hole provided on a corresponding decorative piece, or mounted within the installation hole provided on a corresponding decorative piece.

15. The support comprises an auxiliary supporting component to hang the decorative light, erect the decorative light, spike mount the decorative light or hook the decorative light on a wall, and a supporting frame fixed onto the auxiliary supporting component; the fixing frames are fixed on the supporting frame.

The technical solutions according to the decorative light of the present invention have the following beneficial effects: the decorative pieces and the wire are independently mounted onto the fixing frames, and hence, the wire and the decorative pieces will not directly come into contact that results in tangling. Therefore, the decorative pieces are easy to install and uninstall, and the decorative pieces can be easily replaced. The decorative light provided by the present invention is structurally simple and easy to install and uninstall.

Further, the wire slots facilitate the wire to pass therethrough so that the wire can be quickly arranged on the fixing frames. Wire arrangement of the present invention is simple and the efficiency.

REFERENCES IN THE FIGURES

Figure 1:
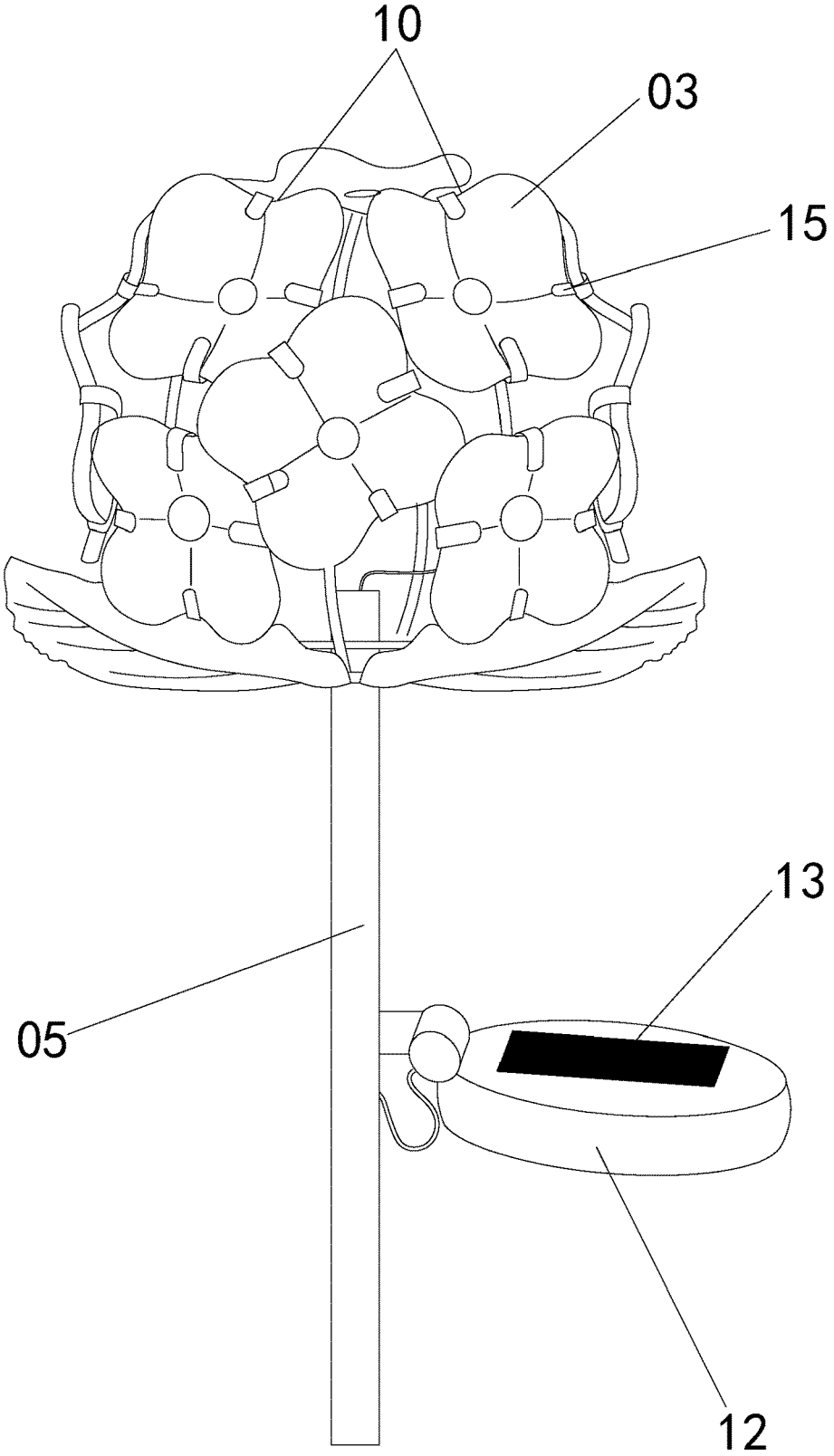
FIG. 1 is a schematic structural view of embodiment 1 of the present invention.
Figure 2:
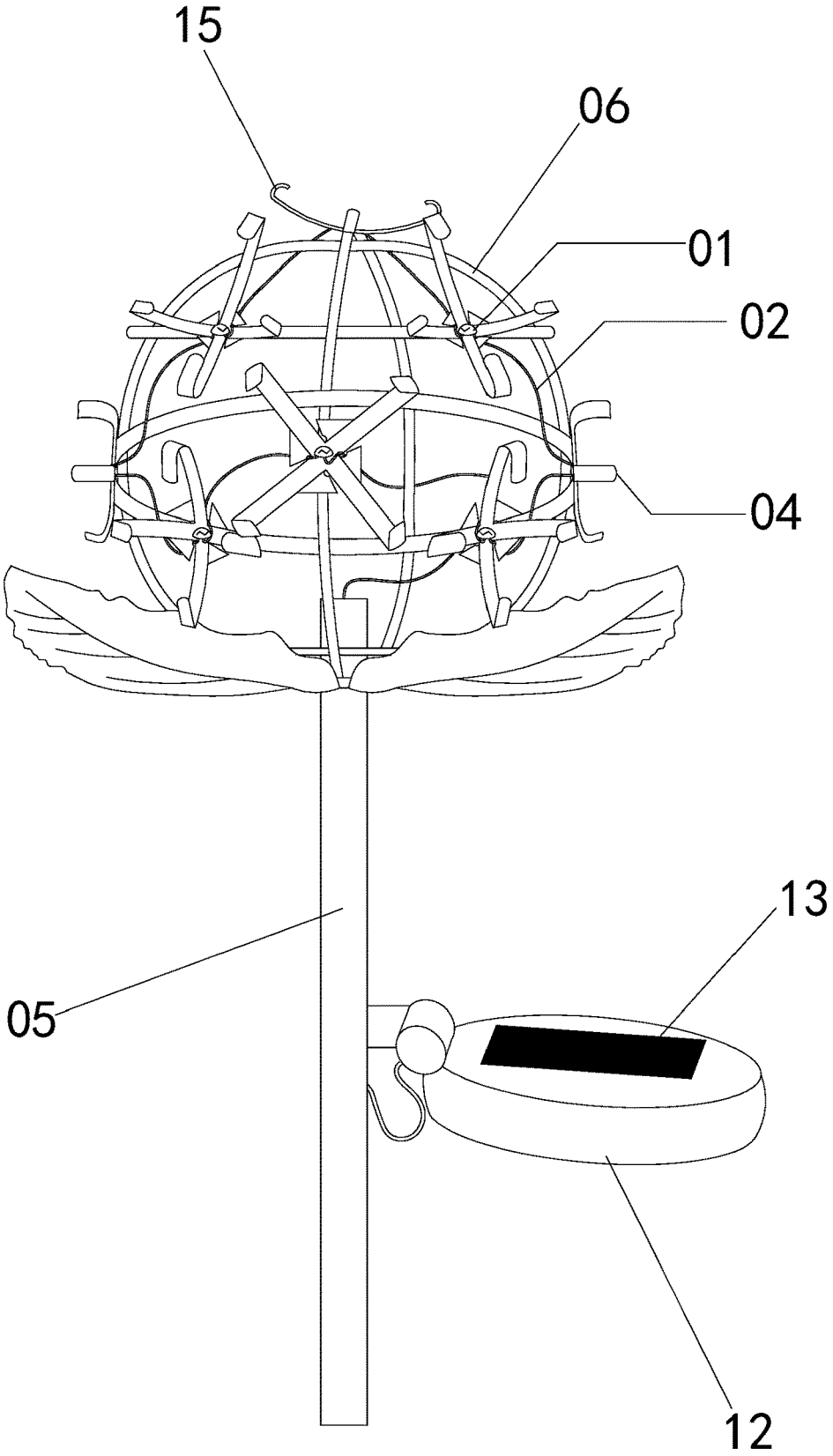
FIG. 2 is another schematic structural view of embodiment 1 of the present invention, with the decorative pieces omitted from the figure.
Figure 3:
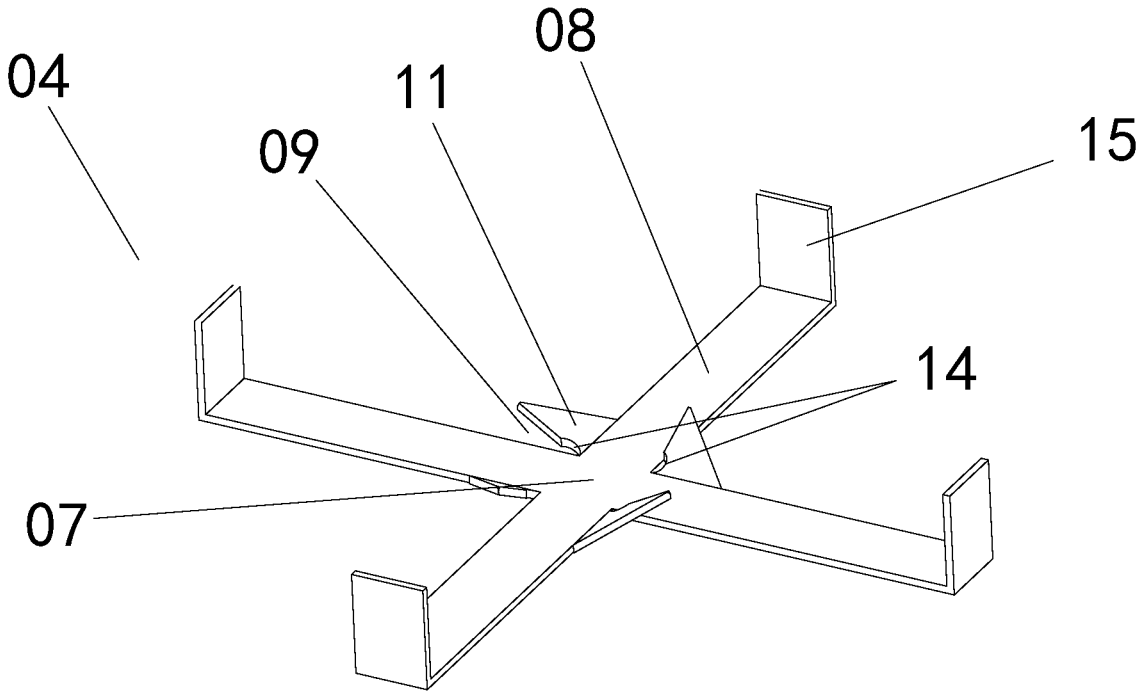
FIG. 3 is a schematic structural view of the fixing frame according to embodiment 1 of the present invention.
Figure 4:
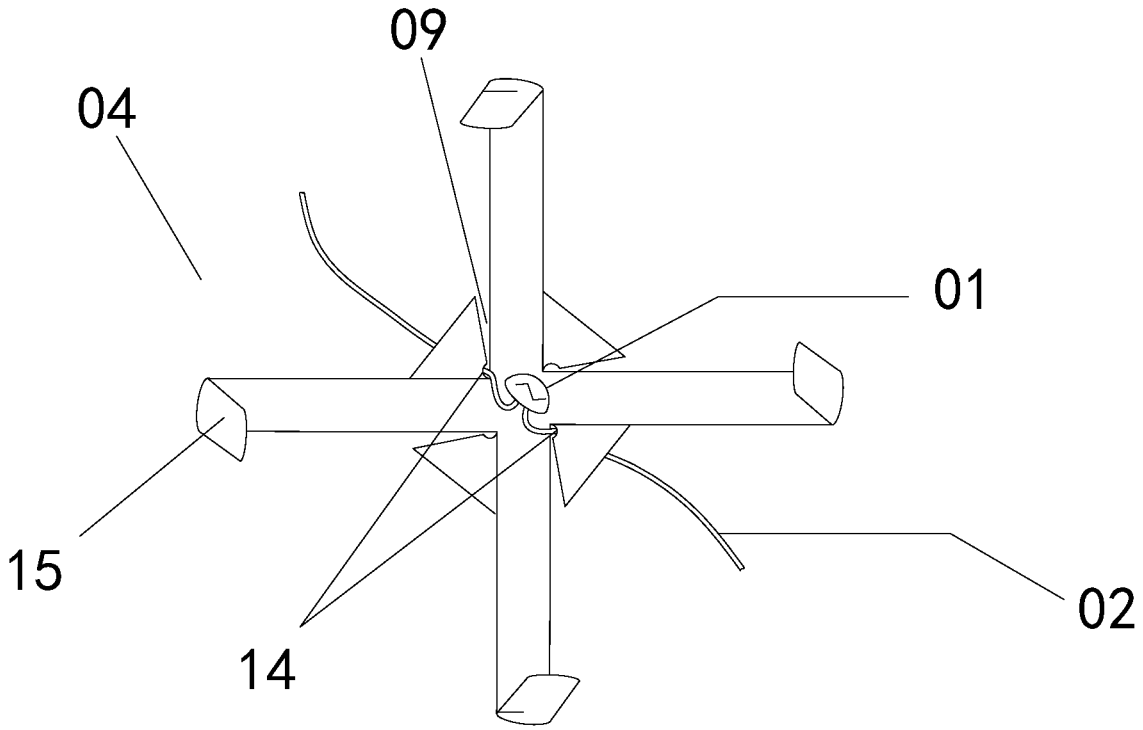
FIG. 4 illustrates the fixing frame in a use condition according to embodiment 1 of the present invention.
Figure 5:
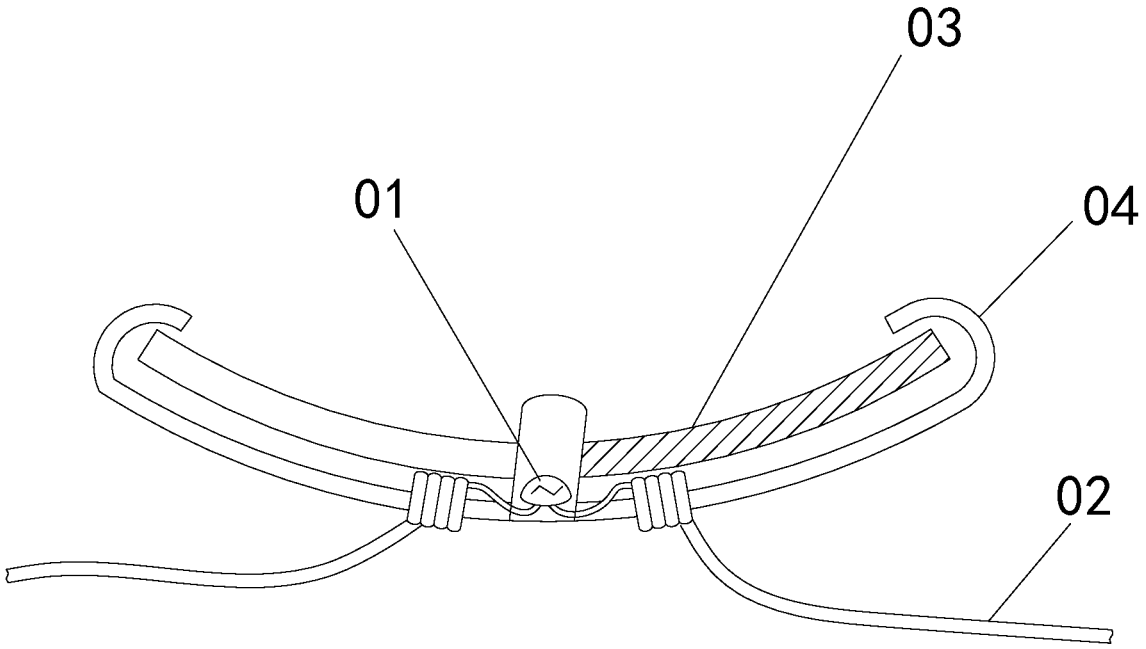
FIG. 5 is a side view of the light-emitting decorative assembly according to embodiment 1 of the present invention.

| | |
|---|---|
| 01: light beads | 02: wire |
| 03: decorative sheet | 04: fixing frame |
| 05: rod | 06: cage frame |
| 07: mounting portion | 08: clamping arms |
| 09: wire slots | 10: recessed portion |
| 11: guiding plates | 12: shell |
| 13: solar panel | 14: position limiting groove |
| 15: bended portion | |

DETAILED DESCRIPTION OF THE INVENTION

To further explain the technical solutions of the present invention, the present invention will be further described in detail below with reference to some embodiments.

Embodiment 1

As shown in FIGS. 1-5, a decorative light comprises a support and a plurality of light-emitting decorative assemblies fixed on the support. The light-emitting decorative assemblies as a whole comprise decorative pieces, fixing frames 04, a wire 02 provided with a plurality of light beads 01 thereon, and a power supply device that provides working power for the light beads 01. The light beads 01 are light-emitting components. Each light-emitting decorative assembly has one decorative piece and one fixing frame, and the decorative piece and the fixing frame are mounted together correspondingly, and the wire 02 and the decorative piece are independently disposed on a corresponding fixing frame 04. The light beads 01 correspond to the decorative pieces respectively. The decorative pieces can be designed as different plants or animals. In the present embodiment, the decorative pieces are decorative sheets 03 each having a flower shape. The support comprises an auxiliary supporting component, and a supporting frame fixed onto the auxiliary supporting component. The auxiliary supporting component is a hanging component for hanging the decorative light, an erecting component for erecting the decorative light, an insertion component for spike mounting the decorative light, or a hook component for hanging the decorative light on a wall. The insertion component is illustrated as the auxiliary supporting component in the present invention; the insertion component is preferably a rod 05; the support frame is preferably a circular cage frame 06 that may embody the decorative light as a circular lantern. The fixing frames 04 are fixed on the cage frame 06. The cage frame 06 comprises a plurality of supporting ribs. The cage frame 6 has a hollow interior.

Each fixing frame 04 comprises a central mounting portion 07 and a support portion extending radially and outwardly from the central mounting portion 07. The support portion comprises a plurality of clamping arms 08 that clamp a corresponding decorative sheet 03; the clamping arms 08 extend radially and outwardly from the central mounting portion 07. A free end of each clamping arm 08 is bended as a bended portion 15. The wire 02 can be directly mounted to one or both of the mounting portion 07 and the support portion by winding thereon. As such, wire arrangement on the fixing frame 04 is convenient.

Each fixing frame 04 is provided with wire slots 09 that allow the wire 02 to pass through. The plurality of fixing frames 04 are evenly distributed and fixed onto the cage frame 06. The decorative sheets 03 are removably mounted on the fixing frames 04 respectively. The wire 02 is disposed on the fixing frames 04 in a way that lights emitted from the light beads 01 illuminate through the decorative sheets 03, for example, each light bead 01 is mounted between a corresponding fixing frame 04 and a corresponding decorative sheet 03, or mounted at a corresponding fixing frame 04 at a position corresponding to an installation hole provided on a corresponding decorative sheet 03, or mounted within the installation hole provided on a corresponding decorative sheet 03, or mounted at otherwise other positions not mentioned above. In the present embodiment, each light bead 01 is mounted between a corresponding fixing frame 04 and a corresponding decorative sheet 03. Each of the decorative sheets 03 having the flower shape comprises a plurality of petals; a recessed portion 10 is provided between every two adjacent petals to facilitate clamping by a corresponding bended portion 15. Shape and size of each decorative sheets 03 correspond to a shape and size of a corresponding fixing frame 04.

Further, each support portion comprises four clamping arms 08; the four clamping arms 08 are evenly distributed around the mounting portion 07. The fixing frame 04 has a cross shape. Correspondingly, four guiding plates 11 are connected with the mounting portion 07. The four guiding plates 11 are slanted and each being arranged between two adjacent clamping arms 08. Each guiding plate 11 has a triangular shape having a first vertex, a second vertex and a third vertex. The first vertex is connected to the mounting portion 07, the second vertex and the third vertex are positioned on two opposite sides respectively with respect to a plane where the mounting portion 07 lies; in other words, the second vertex is positioned at a first side of the plane where the mounting portion 07 lies, while the third vertex is positioned at a second side opposite to the first side of the plane where the mounting portion lies. Each wire slot 09 is defined between a corresponding guiding plate 11 and a corresponding clamping arm 08. Each guiding plate 11 intersects with the plane where the mounting portion 07 lies, thereby defining an included angle with respect to the plane where the mounting portion lies; the included angle facilitates the wire 02 to pass through the wire slots 09 to achieve wire arrangement. The wire slots 09 correspond to a size and specification of the wire 02. The four guiding plates 11 are distributed in a pattern resembling the blades of a windmill. Each light bead 01 is correspondingly disposed at a center of a corresponding decorative sheet 03. Alternatively, each light bead 01 may be disposed at any other positions apart from the center of a corresponding decorative sheet 03, preferably at positions where the lights emitted by the light bead 01 can pass through the decorative sheet 03. According to a more preferred embodiment, an end of each wire slot 09 proximal to the mounting portion 07 is provided with a position limiting groove 14; a width of each wire slot 09 gradually reduces from an end away from the mounting portion to the end proximal to the mounting portion. Each wire slot 09 is in communication with the corresponding position limiting groove 14 provided thereon. All position limiting grooves 14 correspond to the wire 02 in respect of shape and size. It should be noted that, apart from being each disposed between a corresponding guiding plate 11 and a corresponding clamping arm 08, the wire slots 09 may also be provided at the mounting portion 17 or the support portion, or simultaneously provided at the mounting portion 17 and the support portion.

Further, the decorative sheets 03 are made by common transparent materials, preferably glass. It should be noted that, the decorative sheets may also be provided with hollowed portions instead to achieve light permeation, such that light passes through the decorative sheets by passing through the hollowed portions.

Further, the power supply device uses solar power supply assembly. The solar power supply assembly comprises a shell 12, a solar panel 13, a storage battery and a control circuit that controls power output and recharge. The solar panel 13 is fixed to an outer surface of the shell 12. The shell 12 is mounted onto the rod 05. During recharging, the solar panel 13 faces towards sunlight. The storage battery and the control circuit are provided inside the shell 12. The storage battery and the control circuit are connected to each other bidirectionally; the solar panel 13 is connected to an input end of the control circuit. An output end of the control circuit is electrically connected with the light beads 01 via a control button.

Further, each decorative sheet 03 has a recessed center; a shape of each fixing frame 04 corresponds to an outer contour curvature of a corresponding decorative sheet.

During installation, in each fixing frame, one end of the wire 02 passes through a corresponding wire slot 09 of one of the guiding plates 11 and being limited within the position limiting groove 14 of the corresponding wire slot 09; and another end of the wire 02 passes through a corresponding wire slot 09 of another one of the guiding plates 11 and being limited within the position limiting groove 14 of the corresponding wire slot 09; adjust the light bead 01 so that the light bead 01 is positioned on a surface of the mounting portion 07 facing towards a corresponding decorative sheet 03; and then the decorative sheet 03 is clamped by the bended portions 15 so that the decorative sheet 03 is fixed onto the fixing frame 04. Accordingly, all light beads 01 are corresponding disposed at center positions of their respective corresponding decorative sheets 03. When it is required to replace the decorative sheets 03, it is only required to bend the bended portions 15 to disengage the decorative sheets 03 from their respective fixing frames 04, such as to achieve replacement with other decorative pieces of different designs. During replacement, the wire 02 can remain in its original position. Therefore, the decorative light provided by the present invention is structurally simple, convenient in wire arrangement, and easy to install and uninstall.

It should be noted that, according to the decorative light according to the present embodiment, lights emitted by the light beads 01 pass through the decorative sheets 03. Since the decorative sheets 03 are transparent and contain a visible outer contour, 2D or 3D designs consisting of animals and plants such as turtles and flowers as provided by the decorative sheets 03 are visible when the decorative light is turned on, thereby providing a pleasant presentation of the decorative light.

Embodiment 2

This embodiment is different from embodiment 1 in respect of the arrangement of light beads and the wire. In this embodiment, only one light bead is provided and fixed to an upper end of the rod. Further, the light bead is positioned within the hollow interior of the cage frame. In the present embodiment, the wire is not required to be run between the fixing frames.

Embodiment 3

Figure 6:
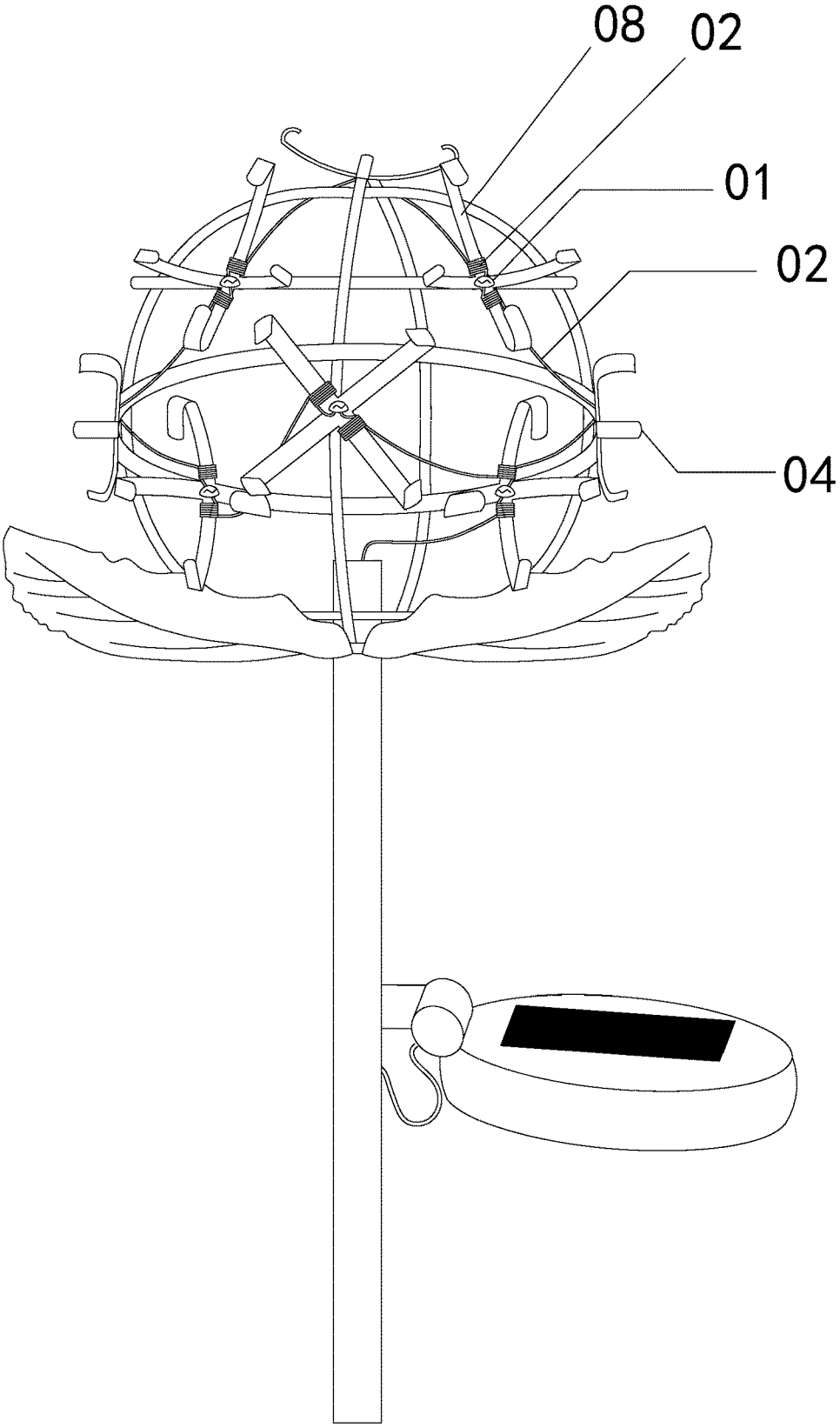
FIG. 6 is a schematic structural view of embodiment 3 of the present invention, with the decorative pieces omitted from the figure.

This embodiment is different from embodiment 1 in respect of how the wire 02 winds around the fixing frames 04. As shown in FIG. 6, the wire 02 according to the present embodiment can directly coil around the clamping arms 08.

Embodiment 4

A decorative light, comprising a support and a plurality of light-emitting decorative assemblies fixed on the support. Each light-emitting decorative assembly comprises a decorative piece and a fixing frame. Therefore, a plurality of light-emitting decorative assemblies comprise a corresponding plural number of decorative pieces and fixing frames. The decorative piece and the fixing frame are mounted together correspondingly. The decorative pieces can be designed as different plants or animals. In the present embodiment, the decorative pieces are decorative sheets 03 each having a flower shape. The support comprises a rod and a cage frame fixed on the rod. The fixing frames are fixed on the cage frame. The cage frame may that of a circular lantern. The cage frame comprises a plurality of supporting ribs. The cage frame has a hollow interior.

The fixing frames are evenly distributed and fixed to the cage frame. The decorative sheets are removably fixed to the fixing frames correspondingly. The decorative sheets are made by common light-emitting materials, such as acrylic material.

Each fixing frame comprises a central mounting portion and a support portion extending radially and outwardly from the central mounting portion. The support portion comprises a plurality of clamping arms that clamp a corresponding decorative sheet; the clamping arms extend radially and outwardly from the central mounting portion. A free end of each clamping arm is bended in a direction towards the mounting portion to form a bended portion.

Each of the decorative sheets having the flower shape comprises a plurality of petals; a recessed portion is provided between every two adjacent petals to facilitate clamping by a corresponding bended portion. Shape and size of each decorative sheet 03 correspond to a shape and size of a corresponding fixing frame.

Further, the fixing frame has four clamps, in other words, four clamping arms are provided; the four clamping arms are evenly distributed around the mounting portion 07. The fixing frame has a cross shape. Alternatively, the fixing frame has three clamps, in other words, three clamping arms are provided; the three clamping arms are evenly distributed around the mounting portion. In the present embodiment, number of clamping arms can be determined according to practical situation.

Further, each decorative sheet has a recessed center; a shape of each fixing frame corresponds to an outer contour curvature of a corresponding decorative sheet.

During installation, in each fixing frame, the decorative sheet is clamped by the bended portions so that the decorative sheet is fixed onto the fixing frame. When it is required to replace the decorative sheets, it is only required to bend the bended portions to disengage the decorative sheets from their respective fixing frames, such as to achieve replacement with other decorative pieces of different designs. Therefore, the decorative light provided by the present invention is structurally simple and easy to install and uninstall.

It should be noted that, according to the decorative light of the present embodiment, the decorative sheets are made of light-emitting materials. Since the decorative sheets emit lights and contain a visible outer contour, 2D or 3D designs consisting of animals and plants such as turtles and flowers as provided by the decorative sheets are visible when the decorative light is turned on, thereby providing a pleasant presentation of the decorative light.

The embodiments as described and the figures as illustrated are not intended to limit the form and configuration of the present invention. Any appropriate changes or modifications made by any person skilled in this field of art should also fall within the scope of the present invention.

What is claimed is:

1. A light-emitting decorative assembly, comprising a decorative piece and a fixing frame, and also comprising a wire; the decorative piece is removably mounted on the fixing frame; the wire is disposed on the fixing frame; the wire is provided with light-emitting components that emit lights passing through the decorative piece; the decorative piece is a decorative sheet having a flower shape; the decorative sheet comprises a plurality of petals; a recessed portion cooperative with the fixing frame is provided between every two adjacent petals.

2. The light-emitting decorative assembly of claim 1, wherein the fixing frame is provided with wire slots; the wire is arranged on the fixing frame via the wire slots.

3. The light-emitting decorative assembly of claim 1, wherein the decorative sheet is transparent.

4. The light-emitting decorative assembly of claim 3, wherein the decorative sheet is made by transparent material, or the decorative sheet is provided with hollowed portions to achieve light permeation.

5. A decorative light, comprising a support and a plurality of light-emitting decorative assemblies fixed on the support; each light-emitting decorative assembly comprises a decorative piece, a fixing frame, and a wire; the fixing frame of each light-emitting decorative assembly is fixed on the support; the wire and the decorative piece are independently disposed on a corresponding fixing frame; the decorative piece is removably mounted on the corresponding fixing frame; the wire is disposed with light-emitting components that emit lights passing through each decorative piece; the fixing frame has three clamping arms or four clamping arms; the light-emitting components of the wire are disposed correspondingly to the decorative pieces respectively.

6. The decorative light of claim 5, wherein the fixing frame is provided with wire slots; the wire is fixed on each fixing frame via wire slots of different positions in each fixing frame.

7. The decorative light of claim 5, wherein each light-emitting component is mounted between a corresponding fixing frame and a corresponding decorative piece, or mounted at a corresponding fixing frame at a position corresponding to an installation hole provided on a corresponding decorative piece, or mounted within the installation hole provided on a corresponding decorative piece.

8. The decorative light of claim 5, wherein the support comprises an auxiliary supporting component to hang the decorative light, erect the decorative light, spike mount the decorative light or hook the decorative light on a wall, and a supporting frame fixed onto the auxiliary supporting component; the fixing frames are fixed on the supporting frame.

* * * * *